US011124333B2

(12) United States Patent
Robles González et al.

(10) Patent No.: US 11,124,333 B2
(45) Date of Patent: Sep. 21, 2021

(54) METAL CROWN CAP HAVING A SHORT CLOSURE SKIRT

(71) Applicant: FÁBRICAS MONTERREY, S.A. DE C.V., Nuevo León (MX)

(72) Inventors: Gilberto Robles González, Nuevo León (MX); Eric Gerardo Rodríguez Balbuena, Nuevo León (MX); Romualdo Segura Ruiz, Nuevo León (MX)

(73) Assignee: FÁBRICAS MONTERREY, S.A. DE C.V., Nuevo León (MX)

( * ) Notice: Subject to any disclaimer, the term of this patent is extended or adjusted under 35 U.S.C. 154(b) by 124 days.

(21) Appl. No.: 16/064,148

(22) PCT Filed: May 20, 2016

(86) PCT No.: PCT/MX2016/000049
§ 371 (c)(1),
(2) Date: Jun. 20, 2018

(87) PCT Pub. No.: WO2017/111571
PCT Pub. Date: Jun. 29, 2017

(65) Prior Publication Data

US 2018/0370692 A1 Dec. 27, 2018

(30) Foreign Application Priority Data

Dec. 21, 2015 (MX) ..... MX/a/2015/018006

(51) Int. Cl.
*B65D 41/12* (2006.01)
*B65D 41/08* (2006.01)

(52) U.S. Cl.
CPC ..... *B65D 41/12* (2013.01); *B65D 41/08* (2013.01); *B65D 41/125* (2013.01)

(58) Field of Classification Search
CPC ..... B65D 41/12; B65D 41/125; B65D 41/08
USPC ..... 220/328
See application file for complete search history.

(56) References Cited

U.S. PATENT DOCUMENTS

| | | | |
|---|---|---|---|
| 3,061,130 A | 10/1962 | Husum | |
| 3,273,736 A | 9/1966 | Lister et al. | |
| 3,648,874 A | 3/1972 | Moller | |
| 4,337,871 A | 7/1982 | Tucker | |
| 5,458,253 A | 10/1995 | Shapcott | |
| 8,056,743 B2 | 11/2011 | Zanoni et al. | |

(Continued)

FOREIGN PATENT DOCUMENTS

| | | | | |
|---|---|---|---|---|
| CA | 1252431 A | | 4/1989 | |
| GB | 963074 A | * | 7/1964 | ..... B65D 41/12 |

*Primary Examiner* — James N Smalley
(74) *Attorney, Agent, or Firm* — BakerHostetler

(57) ABSTRACT

A cap for sealing a mouth of a crown finish or threaded crown finish glass bottle, the crown cap is formed by a circular wall, a curved wall perimetrical to the circular wall, and a closure skirt that descends radially downward and outward from the curved wall and formed by a plurality of interleaved protrusions and depressions, the curved wall has a radius of curvature from 1.5 mm (0.590551 in) to 1.9 mm (0.748031 in) and an arc less than 86°; the crown cap is formed from a circular sheet cutout with a diameter from 33.4949 mm (1.3187 in) to 35.5346 mm (1.399 in), resulting in a crown cap with an axial height less than the axial height of a crown cap from the state of the art.

16 Claims, 11 Drawing Sheets

(56) References Cited

U.S. PATENT DOCUMENTS

| | | | | |
|---|---|---|---|---|
| 8,322,549 | B2 | 12/2012 | Bourque et al. | |
| 2001/0035390 | A1* | 11/2001 | Vilacha Zanoni ..... | B65D 41/42<br>215/327 |
| 2005/0029218 | A1 | 2/2005 | Golding | |
| 2005/0167392 | A1 | 8/2005 | Martinez | |
| 2009/0261056 | A1 | 10/2009 | Bourque et al. | |
| 2015/0232236 | A1 | 8/2015 | Camacho Paredes et al. | |

* cited by examiner

METAL CROWN CAP HAVING A SHORT CLOSURE SKIRT

CROSS-REFERENCE TO RELATED APPLICATIONS

This application is the National Stage of International Patent Application No. PCT/MX2016/000049, filed May 20, 2016, which claims the benefit of Mexican application number MX/a/2015/018006, filed Dec. 21, 2015, the disclosures of which are incorporated herein by reference in their entireties.

TECHNICAL FIELD OF THE INVENTION

The present invention relates to metallic caps, particularly to a crown cap having an axial height less than the axial height of a crown cap from the state of the art.

BACKGROUND OF THE INVENTION

With reference to FIG. 1, there is illustrated a longitudinal section of a crown cap 1 from the state of the art, which is formed by an inner face/outer face laminar piece, which includes a circular wall 2, a curved wall 3 perimetrical to the circular wall 2, and a closure skirt 4 descending from the curved wall 3 and formed by a plurality of projections 5 and interleaved depressions 6. Each projection 5 is identical to all other projections 5 of the closure skirt 4, and each depression 6 is identical to all other depressions 6 of the closure skirt 4. Alternatively, the crown cap 1 includes a sealing gasket 7 of circular shape with a perimetrical lip 8 and placed on the inner face of the circular wall 2.

In accordance with the German standard DIN 6099 of July 1997, a crown cap 1 of twenty-one projections 5 has an internal diameter D1 of approximately 26.6 mm (in) to approximately 26.9 mm (in) as measured from the inner face of a rim to an opposite rim of the curved wall 3; an outer diameter D2 of approximately 31.9 mm (1.2559 in) to approximately 32.3 mm (1.2716 in), measured from one rim to an opposite rim of the closure skirt 4; a radius of curvature R1 of the curved wall 3 of 1.5 mm (0.05905 in) to approximately 1.9 mm (0.07480 in) and the curved wall 3 describes an arc of approximately 86.5° to approximately 90°; a radius of curvature R2 of the circular wall 2 of approximately 140 mm (5.5118 in) to approximately 190 mm (7.4803 in) and an axial height H1 of approximately 5.85 mm (0.2303 in) to approximately 6.15 mm (0.2421 in).

The metallic crown caps can be of the following type:

A PRY-OFF crown cap, one that requires the use of a lever-type opener to open the same.

A TWIST-OFF crown cap, one that requires a slight manual torque to cause the rotation of it to open the same.

In turn, the twist-off crown caps could be classified into:

"Rough touch" crown cap, one whose closure skirt, once folded, has a surface formed by generally pointy or sharp projections that are somewhat uncomfortable to the touch.

"Comfortable touch" crown cap, one whose closure skirt, once folded, has a surface formed by generally rounded flat projections that are comfortable to the touch.

Some examples of the twist-off, "rough touch" crown caps from the state of the art are described in patent documents U.S. Pat. No. 5,458,253 and US-2005029218;

while patent documents CA-1252431, U.S. Pat. Nos. 3,648,874, 4,337,871, and

MX-317716 disclose some examples of twist-off, "comfortable touch" crown caps from the state of the art.

The crown cap 1 is preferably applied on a glass bottle mouth having a crown finish or a threaded crown finish, in accordance with the designs established by the Glass Packaging Institute (GPI). FIG. 2A illustrates a crown finish for a mouth 10 of a glass bottle from the state of the art for the 600-26 series, according to the GPI. The mouth 10 has a sealing ring 11, a neck 12 that descends from the sealing ring 11, and a reinforcing ring 13 that descends from the neck 12. The sealing ring 11 and the neck 12 define the closure area 15. The sealing ring 11 has an axial height of approximately 3.7084 mm (0.146 in) to approximately 3.8862 mm (0.153 in) and the neck 12 has a radius of approximately 2.3876 mm (0.094 in). The sealing ring 11 has an internal rim 111 followed by a sealing surface 112 that is in turn followed by a curvature 113 whose outer rim 114 joins the neck 12. The internal rim 111 has a radius that does not exceed approximately 1.1938 mm (0.47 in), the curvature 113 has a radius of approximately 3.9624 mm (0.156 in), and the outer rim 114 has a radius of approximately 0.508 mm (0.020 in).

FIG. 2B illustrates a threaded crown finish for a mouth 10 of a glass bottle from the state of the art for series 513, according to the GPI. The mouth 10 has a sealing ring 11, a neck 12 that descends from the sealing ring 11, and a reinforcing ring 13 that descends from the neck 12. The sealing ring 11 and the neck 12 define the closure area 15. The sealing ring 11 has a minimum axial height of approximately 6.35 mm (0.25 in), and the neck 12 has a radius of approximately 2.3876 mm (0.094 in). The sealing ring 11 has an internal rim 111 followed by a sealing surface 112 that is in turn followed by a curvature 113 followed by threads 116 and finished in an outer rim 114 joined to the neck 12. The internal rim 111 has a radius that does not exceed approximately 0.7874 mm (0.031 in), the curvature 113 has a radius of approximately 0.7874 mm (0.31 in) to approximately 1.6 mm (0.063 in), and the outer rim 114 has a radius of approximately 0.508 mm (0.020 in), while threads 116 are approximately 2.3622 [mm] (0.093 in) apart and have a radius of approximately 0.4064 mm (0.016 in) and protrude at a distance of approximately 0.381 mm (0.015 in) to approximately 0.5842 mm (0.023 in).

Turning now to FIG. 3A, a crown cap 1 placed and folded on the mouth 10 of a crown finish glass bottle according to the state of the art is observed, such that the sealing ring 11 is the part of the mouth 10 interacting with the crown cap 1 in order to seal the glass bottle and its contents, so that on the internal rim 111 and the sealing surface 112, the perimetrical lip 8 of the sealing gasket 7 is compressed; while the closure skirt 4, once folded, is engaged to the closure area 15, particularly fixed on the outer rim 114 and a part folded 9 toward the inside of the neck 12. The folded part 9, for the most part, represents excess material wasted, since the effect of gripping the crown cap 1 on the mouth 10 is effected on the outer rim 114 and not on the neck 12, so that material is not necessary and therefore the amount of material used to make a crown cap 1 can be reduced.

Turning now to FIG. 3B, a crown cap 1 placed and folded on the mouth 10 of a threaded crown finish glass bottle according to the state of the art is observed, such that the sealing ring 11 is the part of the mouth 10 interacting with the crown cap 1 in order to seal the glass bottle and its contents, so that on the internal rim 111 and the sealing surface 112, the perimetrical lip 8 of the sealing gasket 7 is compressed; while the closure skirt 4, once folded, is engaged to the closure area 15, particularly fixed on the outer rim 114 and a part folded 9 toward the inside of the neck 12. The folded closure skirt 4 has a thread 115 interlocked onto the threads 116 of the mouth 10 of the threaded crown finish glass bottle. The folded part 9, for the most part, represents excess material wasted, since the effect of gripping the crown cap 1 on the mouth 10 is effected on the outer rim 114 and not on the neck 12, so that material is not necessary and therefore the amount of material used to make a crown cap 1 can be reduced.

Currently, efforts have been made to reduce the amount of material used to make a crown cap. Two examples of embodiments for this purpose, using the same inventive principle, are described in US patent documents U.S. Pat. Nos. 3,273,736 and 8,056,743B2.

U.S. Pat. No. 3,273,736 discloses a pry-off crown cap, whose curved wall has a radius much wider than the radius of a conventional crown cap (as described in the German standard DIN 6099), whose size is approximately 2 mm (0.08 in) to approximately 2.5 mm (0.10 in) and with a seal of no more than 160 mg of weight. Therefore, die cutting this crown cap requires a circular sheet cutout with a diameter from approximately 36.6 mm (1.44 in) to approximately 37.3 mm (1.47 in).

U.S. Pat. No. 8,056,743B2 discloses a pry-off crown cap 1, as illustrated in FIG. 3C, whose curved wall 3 has a radius similar to the radius of the curvature 113 of the sealing ring 11 of a crown finish for a glass bottle mouth, series 600-26 according to the GPI. That is, the curved wall 3 has a radius of approximately 4 mm (0.157 in), which allows the crown cap 1 to be coupled directly onto the radius curvature 113 of approximately 3.9624 mm (0.156 in) from a mouth 10 of a crown finish glass bottle. This direct coupling of the curved wall 3 of the crown cap 1 on the curvature 113 of the sealing ring 11 of the glass bottle mouth allows making a crown cap 1 that requires less metal. Therefore, to die cut this crown cap, a circular sheet cutout with an approximate diameter of 35.5 mm (1.4 in) is required.

The crown cap of U.S. Pat. No. 3,273,736 and the crown cap of U.S. Pat. No. 8,056,743B2 have the disadvantage that they can only be used to cover a crown finish glass bottle mouth (e.g., GPI 600-26 series), as they cannot be used in a threaded crown finish glass bottle mouth, because the radius of curvature of its respective curved wall is at least 150% greater than the curvature of the sealing ring of a threaded crown finish glass bottle mouth, and therefore it would have coupling and clamping problems, thereby causing a non-airtight seal. Another disadvantage of these crown caps disclosed in the U.S. Pat. Nos. 3,273,736 and 8,056,743B2 is that once the closure skirt is folded on a crown finish glass bottle mouth, there is an part folded in excess toward the inside of the neck of the glass bottle mouth.

In view of the foregoing, it is necessary to provide a crown cap having an axial height less than the axial height of a crown cap from the state of the art, which at the same time retains the sealing characteristics and allows to be crowned on a glass bottle mouth with crown finish or threaded crown finish, and which is also a pry-off or twist-off crown cap, and comfortable touch.

SUMMARY OF THE INVENTION

In view of what has been disclosed above and with the purpose of solving the limitations found in crown caps, it is the purpose of the invention to offer a crown cap in its state prior to its closure to seal a mouth of a crown finish or threaded crown finish glass bottle, the crown cap comprising a inner face/outer face laminar piece, formed by a circular wall, a curved wall perimetrical to the circular wall, and a closure skirt that descends radially downward and outward from the curved wall and formed by a plurality of interleaved projections and depressions; such that the curved wall has a radius of curvature of 1.5 mm (0.590551 in) to 1.9 mm (0.748031 in) and an arc less than 86°, resulting in a shorter closure skirt than the closure skirt of a crown cap from the state of the art.

It is also a purpose of the present invention to provide a closed crown cap by sealing a mouth of a crown finish or threaded crown finish bottle, the closed crown cap comprising a laminar piece formed by a circular wall, a curved wall perimetrical to the circular wall, and a closure skirt marginally folded on the mouth of the glass bottle and descending radially downward from the curved wall, such that the closure skirt is formed with minor projections and interleaved gripping depressions, wherein each minor projection includes a central depression between a pair of opposite second convex flanks and each gripping depression includes a securing groove and a contact wall.

Another purpose of the present invention is to provide a method for making a crown cap with a short closure skirt for sealing a crown finish or threaded crown finish glass bottle, the method having the steps of providing a circular sheet cutout of a diameter from 33.4949 mm (1.3187 in) to 35.5346 mm (1.399 in); and pushing the circular sheet cutout with a forming punch against a forming die to form a circular wall, a curved wall with a radius of curvature from 1.5 mm (0.590551 in) to 1.9 mm (0.748031 in) and an arc less than 86°, and a closure skirt with projections and depressions.

Finally, it is a purpose of the present invention to provide a method for sealing with a crown cap a crown finish or threaded crown finish glass bottle, the method having the steps of providing a glass bottle having a crown finish or threaded crown finish mouth; placing a crown cap on the mouth of the glass bottle, the crown cap having a circular wall, a curved wall perimetrical to the circular wall, and a closure skirt descending radially downward and outward from the curved wall and formed by a plurality of interleaved protrusions and depressions, and wherein the curved wall has a radius of curvature from 1.5 mm (0.590551 in) to 1.9 mm (0.748031 in) and an arc less than 86°; and vertically and concentrically running a crowning die on the crown cap to collapse and fold the closure skirt marginally on the mouth of the glass bottle, wherein each protrusion collapses vertically and forms a smaller projection that includes a central depression between a pair of opposed second convex flanks, and each depression collapses to form a gripping depression including a securing groove and a contact wall.

BRIEF DESCRIPTION OF THE FIGURES

The characteristic features of the invention are described in the following paragraphs in conjunction with the figures that accompany it, which have the purpose of defining the invention but without limiting the scope thereof.

DETAILED DESCRIPTION OF THE INVENTION

Figure 1:
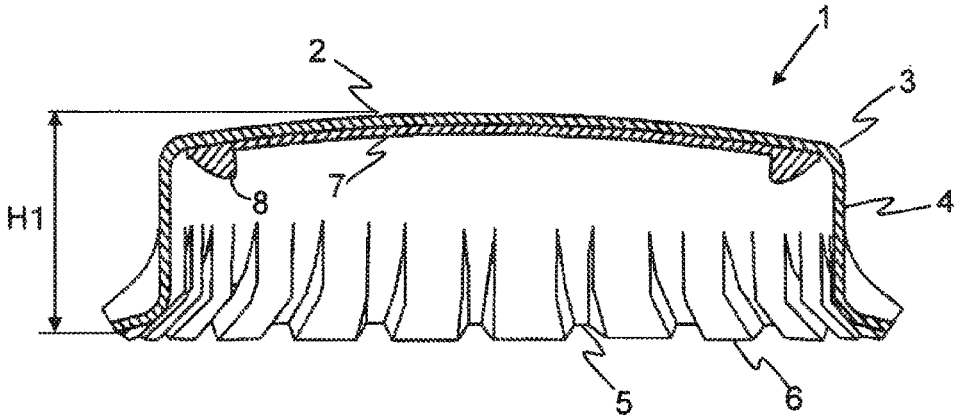
FIG. 1 shows a longitudinal sectional view of a crown cap from the state of the art, in accordance with the German standard DIN 6099 of July 1997.
Figure 2A:
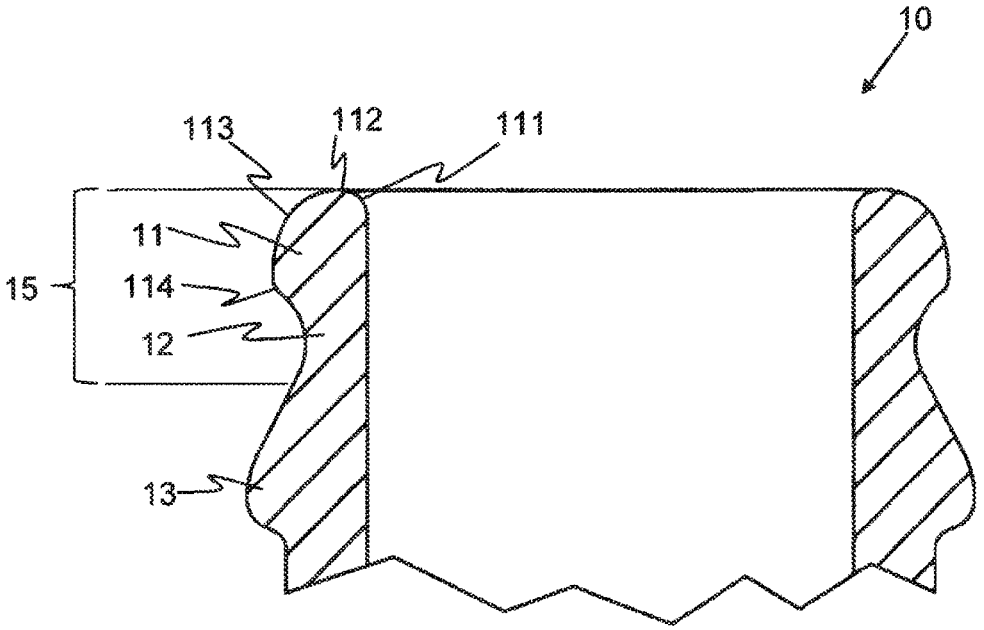
FIG. 2A shows a cross-sectional view of a crown finish for a mouth of a glass bottle from the state of the art, according to the Glass Packaging Institute for series 600-26.
Figure 2B:
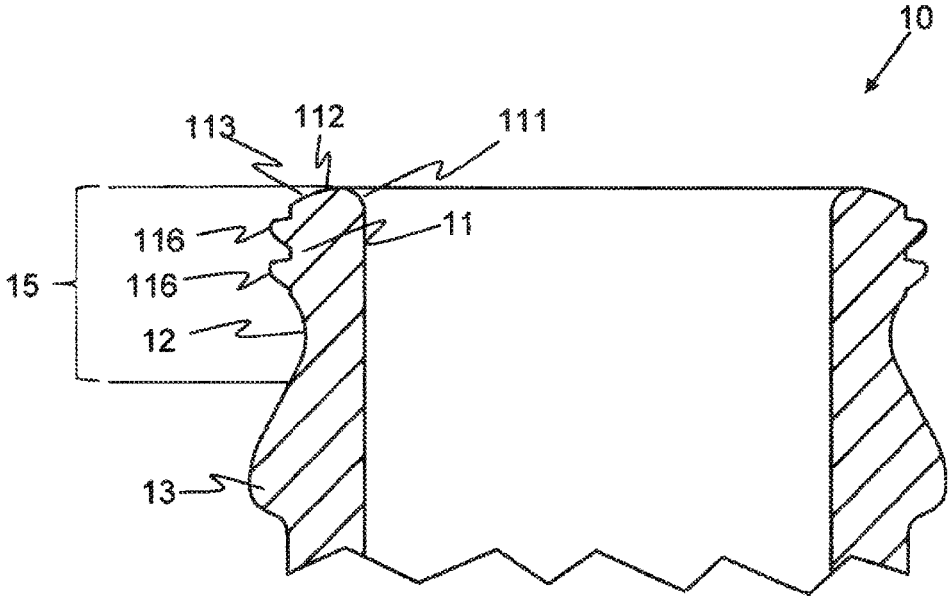
FIG. 2B shows a cross-sectional view of a threaded crown finish for a mouth of a glass bottle from the state of the art, according to the Glass Packaging Institute for series 513.
Figure 3A:
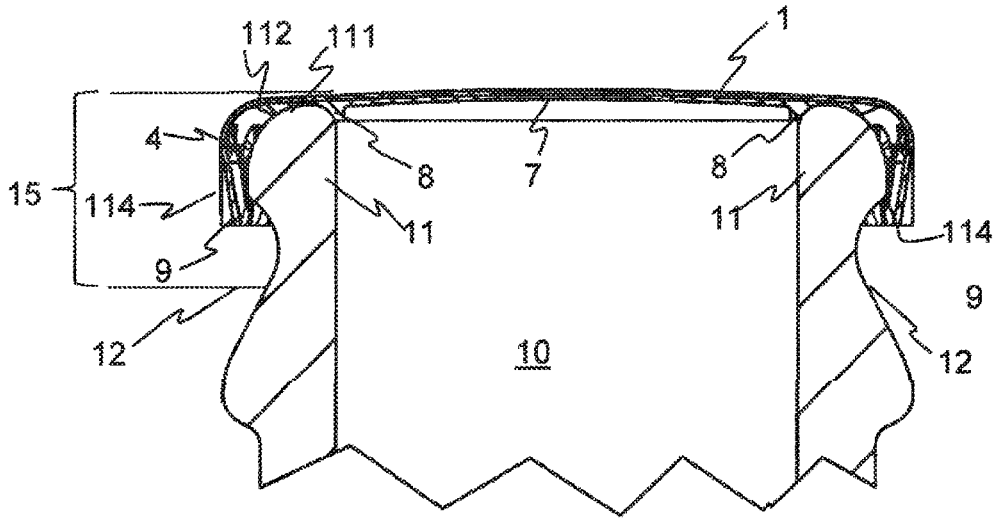
FIG. 3A shows a cross-sectional view of the crown cap of FIG. 1 sealing the mouth of the crown finish glass bottle of FIG. 2A.
Figure 3B:
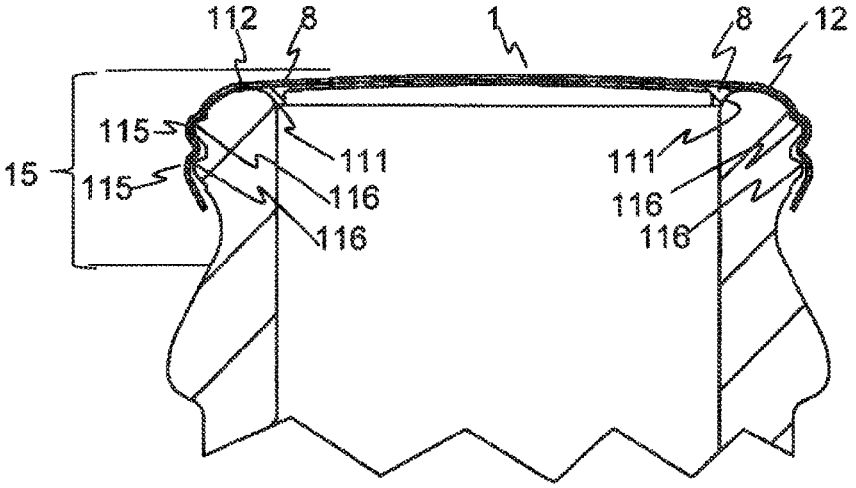
FIG. 3B shows a cross-sectional view of a crown cap of FIG. 1 sealing the mouth of the threaded crown finish glass bottle of FIG. 2B.
Figure 3C:
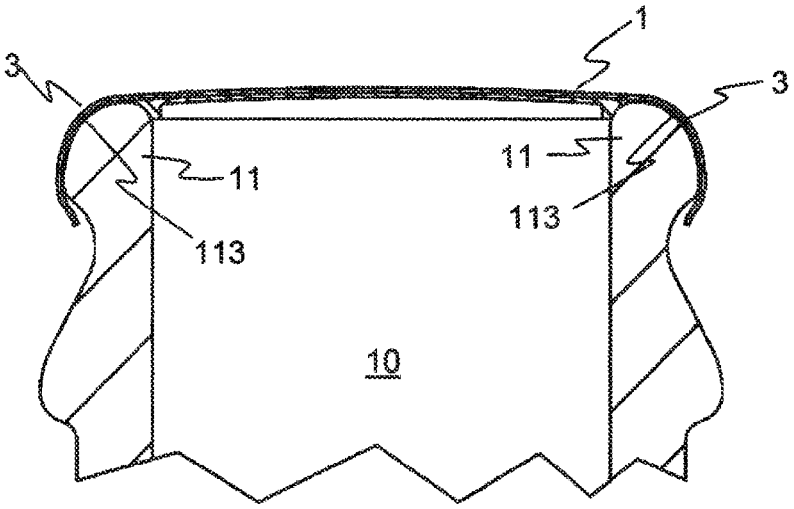
FIG. 3C shows a cross-sectional view of a crown cap from the state of the art disclosed in U.S. Pat. No. 8,056,743B2 and sealing the mouth of the glass bottle of FIG. 2A.
Figure 4A:
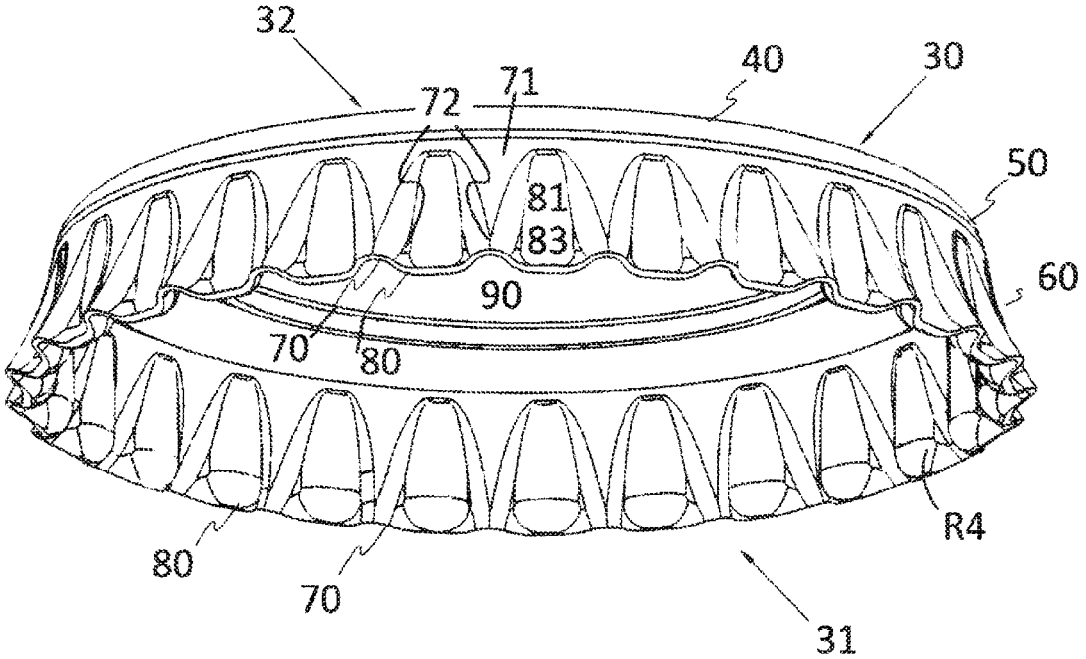
FIG. 4A shows a perspective view of a crown cap according to the invention. The crown cap is illustrated in its pre-closure condition to seal a mouth of a glass bottle.
Figure 4B:
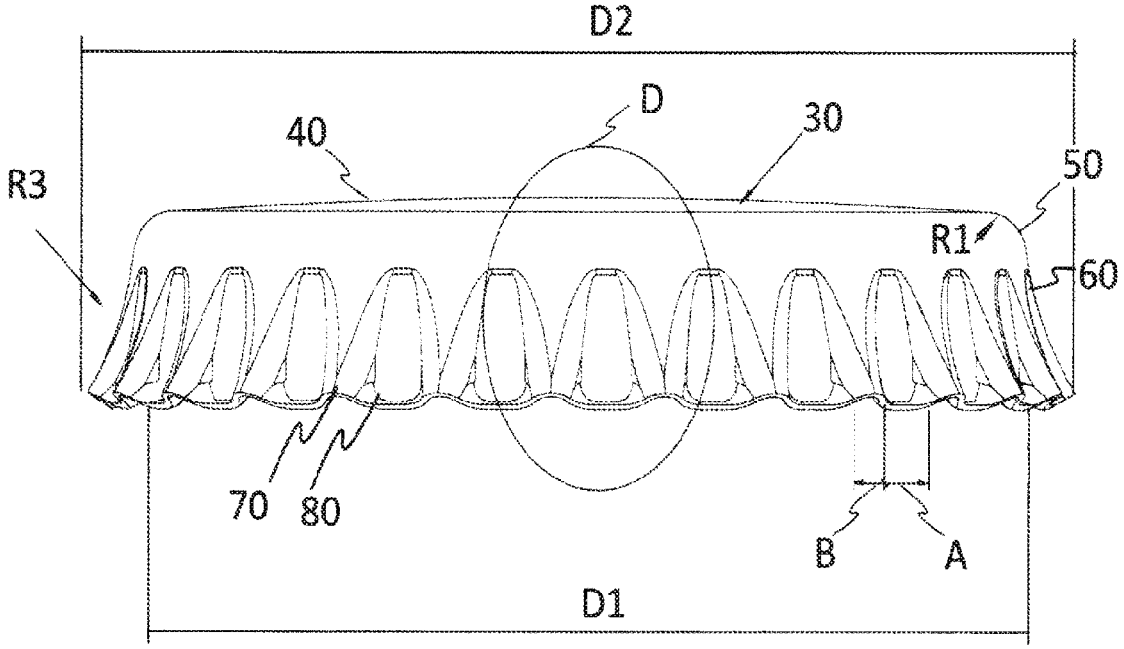
FIG. 4B shows a side view of the crown cap of FIG. 4A, according to the invention.
Figure 4C:
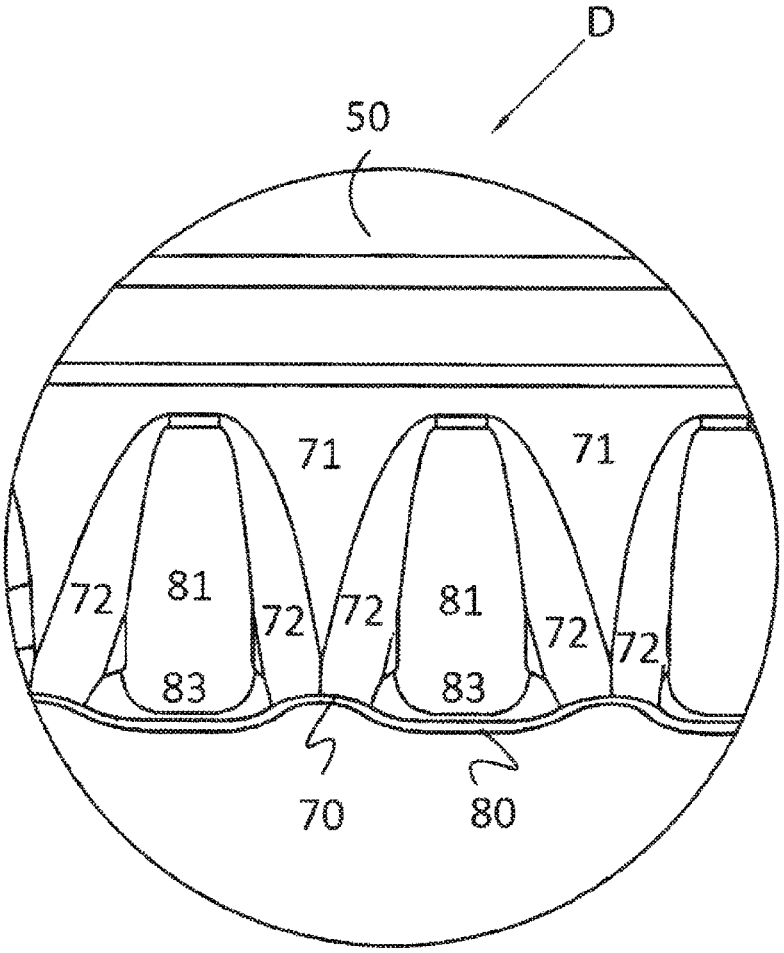
FIG. 4C shows a detailed view of section D of the crown cap of FIG. 4B, according to the invention.

With reference to FIGS. 4A, 4B, and 4C, the crown cap 30 is shown in its pre-closure condition to seal a mouth of a crown finish or threaded crown finish glass bottle. The crown cap 30 is an inner face 31 and outer face 32 laminar piece formed by a circular wall 40, a curved wall 50 perimetrical to the circular wall 40, and a closure skirt 60 descending from the curved wall 50 and formed by a plurality of projections 70 and interleaved depressions 80. Each projection 70 is identical to all the other projections 70 of the closure skirt 60, and each depression 80 is identical to all the other depressions 80 of the closure skirt 60.

The crown cap 30 of the present invention is manufactured based on circular sheet cutouts specially prepared for that purpose. The metallic sheets, preferably made of steel, can be continuous (in rolls) or in cuts or units with the appropriate measures, depending on the type of machine to be used. As an example, metallic sheets can be used with dimensions of 911.5806 mm (35.889 in) for 887.3998 mm (34.937 in) and with a thickness with a range of approximately 0.160 mm (0.00629 in) to approximately 0.210 mm (0.00826 in).

For punching the crown cap 30, a circular sheet cutout with a diameter of approximately 33.4949 mm (1.3187 in) to approximately 35.5346 mm (1.399 in) is required. This represents a reduction in required material compared to the circular sheet cutout required for making crown caps, in accordance with the aforementioned US U.S. Pat. Nos. 3,273,736 and 8,056,743B2. According to the invention, using the aforementioned metallic sheet can [provide?] an increase in the number of crown caps 30 that can be produced compared to the number of crown caps from the state of the art that can be produced using this same sheet.

Figure 5A:
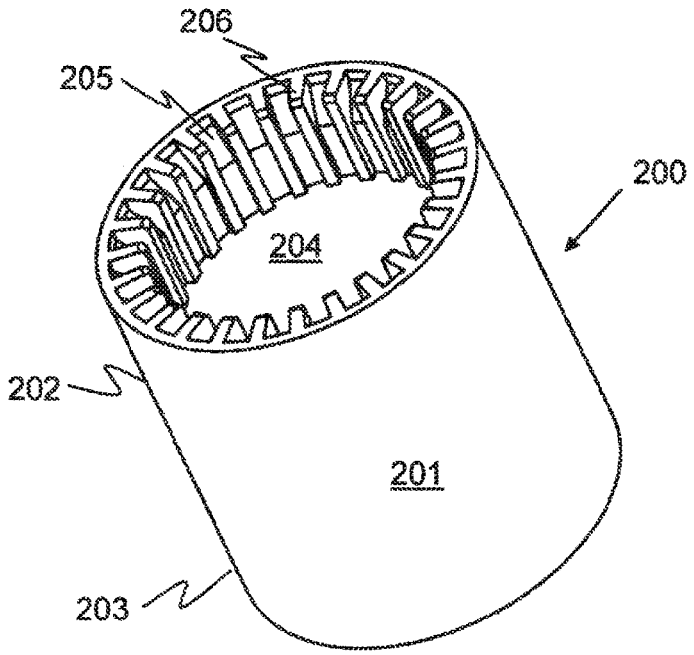
FIG. 5A shows a perspective view of a forming die to form a crown cap in its pre-closure state, according to the invention.

After the circular sheet is cut by a cutting die, in almost the same action, a forming punch pushes the circular sheet cutout against a forming die (see FIG. 5A). The punch establishes the shape and dimensions of the circular wall 40 and the curved wall 50, and the size of the closure skirt 60, while the forming die basically shapes and gives dimension to the projections 70 and depressions 80. In this way, a crown cap 30 of basic form is obtained in its state prior to its closure, which will later be placed on the mouth of a glass bottle to close the same by the use of a crowning machine. The closure skirt 60 has from 17 to 27 projections.

Each projection 70 can have a width of A and each depression 80 can have a width of B. Preferably, the width A of each projection 70 is smaller than the width B of each depression 80.

The curved wall 50 is merged with the circular wall 40 and the closure skirt 60, thereby defining a radius of curvature R1 from approximately 1.5 mm (0.590551 in) to approximately 1.9 mm (0.748031 in). The curved wall 50 has an arc of less than 86°, preferably from approximately 68° to approximately 76°, whereby the axial distance between the surface of circular wall 40 and the beginning of the closure skirt 60 is shorter in comparison with a crown cap from the state of the art, thereby promoting a smoother transition between the curved wall 50 and the closure skirt 60 compared to a crown cap from the state of the art, and therefore, the crown cap 30 has an axial height H2 from approximately 5.3 mm (0.208661 in) to approximately 5.8 mm (0.228346 in).

The crown cap 30 has an inner diameter D1 from approximately 26.6 mm (1.04724 in) to approximately 26.9 mm (1.05905 in), measured from the inner face of a rim to an opposite rim of the curved wall 50, and an outer diameter D2 from approximately 31.9 mm (in) to approximately 32.3 mm (in) [CHECK THIS RANGE, AS IT SHOULD BE LESS THAN THE DIN CAP] measured from one rim to an opposite rim of the closure skirt 60.

From the perspective of the outer face of the crown cap 30, its circular wall 40 is slightly convex, having a radius of curvature R2 from approximately 178 mm (7.0078 in) to approximately 228 mm (8.9763 in).

The outer face 32 is covered, optionally, by a coating on which an advertisement is printed, for example, the brand of the beverage or the bottler. In an alternative embodiment, the inner face 31 could be covered with a coating.

Alternatively, the crown cap 30 includes a sealing gasket 90 of circular shape, positioned on the inner face 31 and particularly adhered to or formed on the coating covering the circular wall 40. The sealing gasket 90 allows an airtight seal on the mouth of the glass bottle to be sealed with the crown cap 30.

As shown in FIGS. 4B and 4C, and taking as a reference for orientation purposes the perspective of the outer face 32 of the crown cap 30, each projection 70 includes an inverted triangular wall 71 formed between a pair of opposite convex flanks 72. The inverted triangular wall 71 descends from the curved wall 50 in the outward direction of the crown cap 30, thereby defining a radius of curvature R3, and it is gently merged with the convex flanks 72.

Preferably, R3 is from approximately 8.74 mm (0.3440 in) to approximately 9.04 mm (0.3555 in). On the other hand, each depression 80 includes a full central wall 81 formed between a pair of opposite convex flanks 72, and a concave bottom wall 83. The full central wall 81 descends from the curved wall 50 substantially parallel to the central axis of the crown cap 30, and this gently merges with the opposite convex flanks 72. The lower concave wall 83 descends from the full central wall 81 and from the convex flanks 72 in the outward direction of the crown cap 30.

Figure 5B:
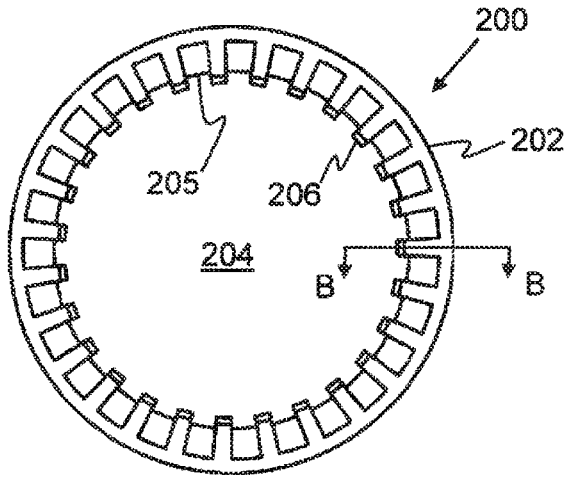
FIG. 5B shows a top view of the forming die shown in FIG. 5A.

FIGS. 5A and 5B depict an exemplary shaped die that can be used to form a crown cap in its pre-closure state, according to the present invention. As shown, a forming die 200 includes a cylindrical wall 201, a forming portion 202 that is an enlargement of the cylindrical wall 201, and a holding portion 203 that is an enlargement of the cylindrical wall 201. The cylindrical wall 201 and the forming portion 202 can define a cylinder having an opening 204 with enlargement therethrough. As shown in FIGS. 5A and 5B, the forming portion 202 includes alternating grooves 205 and ledges 206. Preferably, the grooves 205 are circumferentially and regularly spaced apart by alternating ledges 206, such that each groove 205 is identical to all of the other grooves 205 of the forming portion 202, and each ledge 206 is identical to all of the other ledges 206 of the forming portion 202. Meanwhile, the forming die 200 shows twenty-seven grooves 205 and ledges 206; it is to be understood that the forming die 200 may include any number of grooves 205 and ledges 206. For example, the forming die 200 may include from twenty-one to twenty-seven grooves 205 and ledges 206.

As shown in FIG. 5B, each groove 205 may have a maximum width of C, and each ledge 206 may have a maximum width of D, such that C is greater than D. Since C is greater than D, a crown cap may be made having wider depressions than the width of the projections.

Figure 5C:
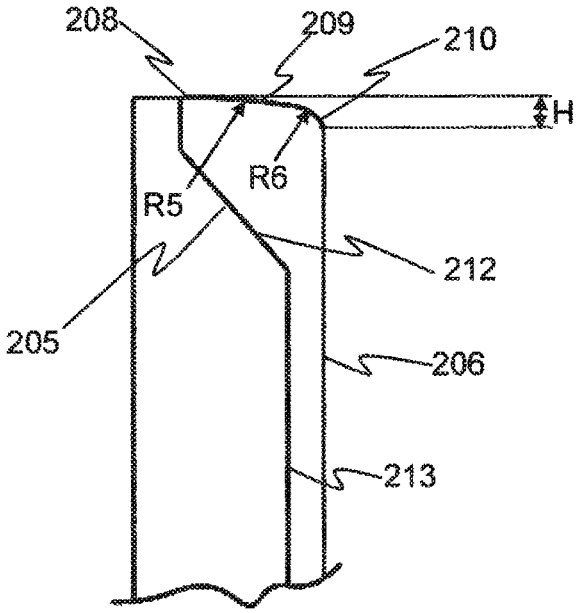
FIG. 5C shows a cross-sectional view of the forming die shown in FIG. 5A through the cutting line B-B'.

FIG. 5C is a cross-sectional view through line BB of FIG. 5B and shows a representative sample of a groove 205 and ledge 206. As shown in FIGS. 5B and 5C, each ledge 206 can include a substantially flat portion 208 and a curved portion 209 that is an enlargement of the flat portion 208. The curved portion 209 may extend toward the center of the forming die 200 at a radius of curvature R5 below the horizontal plane. As shown, each ledge 206 may also include a distal end 210. Preferably, each distal end 210 is curved and has a radius R6. The surface of the flat portion 208 at the edge of the distal end 210 has a height H.

As shown, each groove 205 includes a first vertical flat wall 211, an inclined surface 212 that is an enlargement of the first vertical flat wall 211, and a second vertical flat wall 213 which is an enlargement of the inclined surface 212. The first vertical flat wall 211 extends at approximately a 90° angle from the flat portion 208 and substantially parallel to the axis of the forming die 200. The inclined surface 212 extends toward the center of the forming die 200 at an angle Ø below the horizontal plane.

Figure 6:
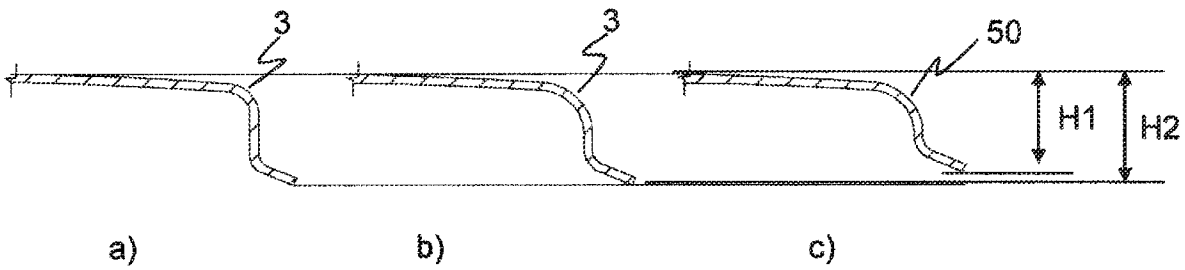
FIG. 6 shows a comparison of axial height and curved wall of a) a profile of a crown cap from the state of the art, in accordance with the German standard DIN 6099 of July 1997, b) a profile of a crown cap in accordance with U.S. Pat. No. 8,056,743B2, and c) a crown cap according to the present invention.

Now, FIG. 6 shows a comparison of axial height and curved wall of a) a profile of a crown cap from the state of the art, in accordance with the German standard DIN 6099 of July 1997, b) a profile of a crown cap in accordance with U.S. Pat. No. 8,056,743B2, and c) a crown cap according to the present invention. In this comparison, the effect of reducing the arc dimension of the curved wall on the axial height of the crown cap for a curved wall having a similar radius of curvature is illustrated. In a first comparison, the radius of curvature of the curved wall 3 of the crown cap from the state of the art of a) and the radius of curvature of the curved wall 50 of the crown cap of the invention of c) are similar. However, the arc of the curved wall 50 of the crown cap of the invention of c) is smaller than the arc of the curved wall 3 of the crown cap from the state of the art of a), thus promoting a significant reduction of the axial height of the crown cap of the invention of c) with respect to the crown cap from the state of the art of a). In a second comparison, the crown cap from the state of the art of a) and the crown cap of U.S. Pat. No. 8,056,743B2 of b) has the same axial height, but they differ in the radius of curvature and the arc size of their respective curved wall 3, the radius of curvature of the curved wall 3 of the crown cap of U.S. Pat. No. 8,056,743B2 of b) being much greater than the radius of curvature of the curved wall 3 of the crown cap from the state of the art of a), but the arc of the curved wall 3 of the crown cap of U.S. Pat. No. 8,056,743B2 of b) is smaller than the arc of the curved wall 3 of the crown cap from the state of the art of a). In a third comparison, the crown cap of the invention of c) and the crown cap of U.S. Pat. No. 8,056,743B2 of b) differ in their axial height, in the radius of curvature, and in the arc of their respective curved wall, the axial height H2 of the crown cap of the invention of c) being smaller than the axial height H1 of the crown cap of U.S. Pat. No. 8,056,743B2 of b), while the radius of curvature of the curved wall 3 of the crown cap of U.S. Pat. No. 8,056,743B2 of b) is much larger than the radius of curvature of the curved wall 50 of the crown cap of the invention of c).

Figure 7A:
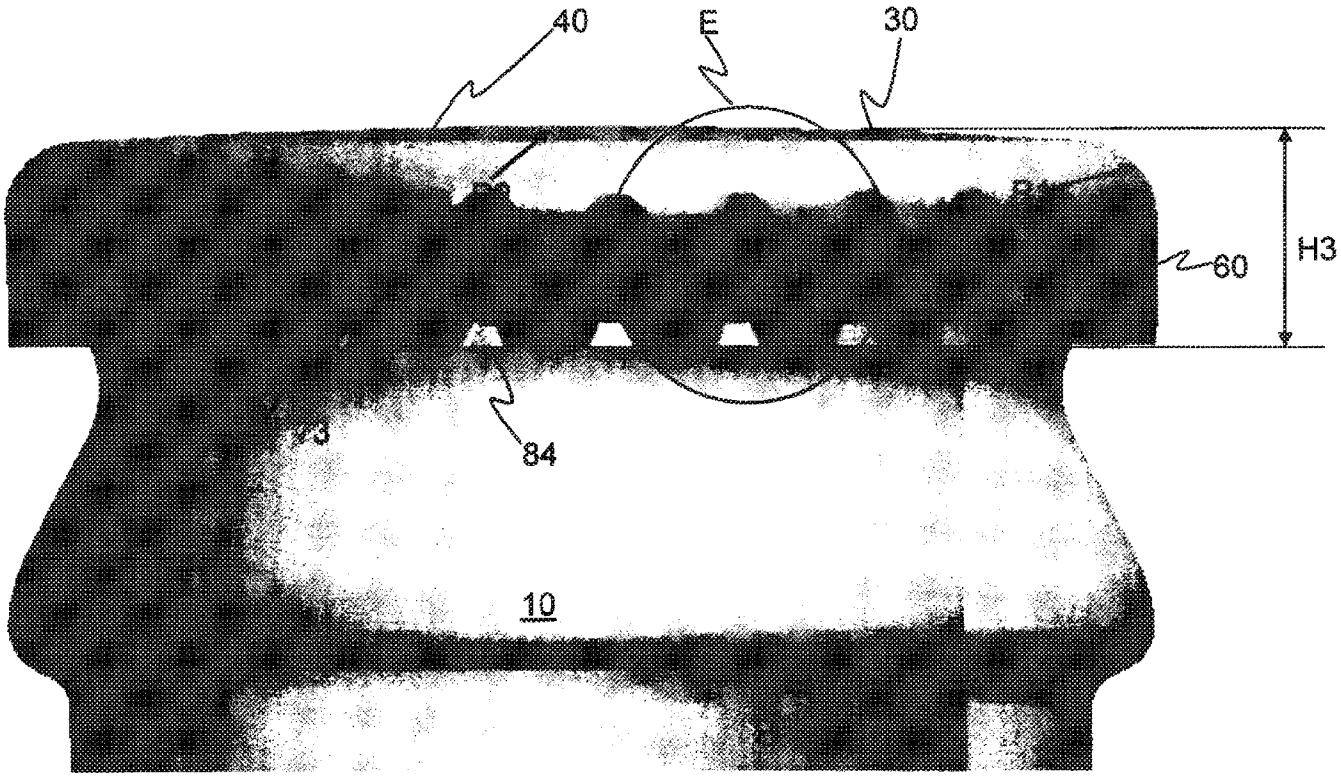
FIG. 7A shows a perspective view of a closed crown cap according to the invention, sealing a crown finish glass bottle mouth.
Figure 7B:
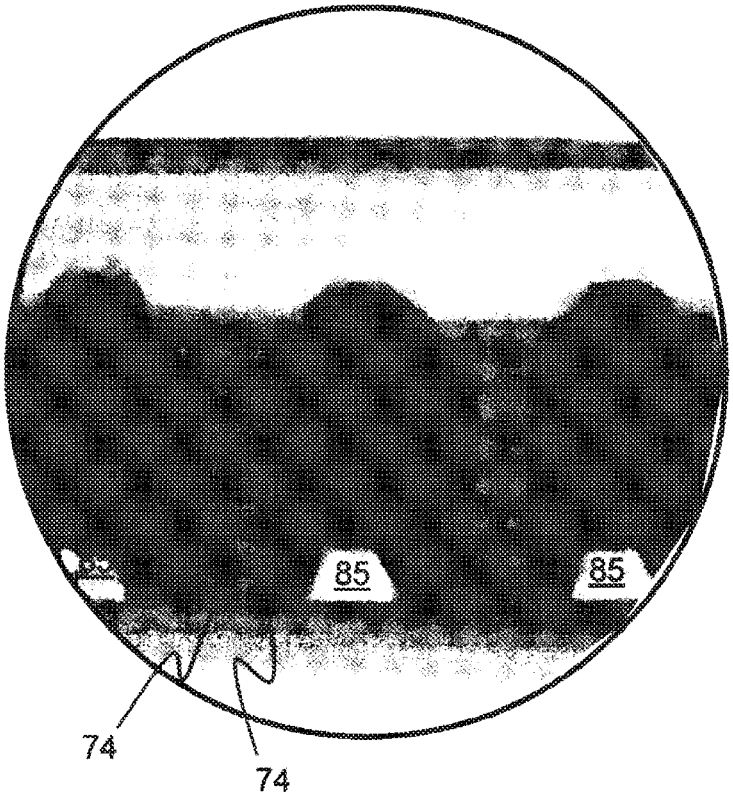
FIG. 7B shows a detailed view of section E of the crown cap of FIG. 7A, according to the invention.

With reference to FIGS. 7A and 7B, a sealed crown finish glass bottle mouth 10 is illustrated with a folded crown cap 30. The crown cap 30 is placed on the mouth 10 of the glass bottle by the use of a crowning machine (not shown) that vertically and concentrically runs a crown die (not shown) that collapses and folds the closure skirt 60 marginally over the mouth 10 of the glass bottle, such that when the closure skirt 60 is folded, each projection 70 (see FIG. 4C) collapses vertically and forms a minor projection 73 that includes a central depression 74 between a pair of convex opposite second flanks 75; while each depression 80 collapses to form a gripping depression 84 which includes a gripping groove 85 and a contact wall 86. Each second convex flank 75 of the minor projection 73 originates from the collapse of a portion of the inverted triangular wall 71 and of a convex flank 72 (see FIG. 4C), while the securing groove 85 and contact wall 86 originates from the collapse of the flat central wall 81 and concave bottom wall 83 (see FIG. 4C).

The crown cap 30, once closed, forms a circular wall 40, a curved wall 50 perimetrical to the circular wall 40, and a folded closure skirt 60 descending from the curved wall 50 and formed by a plurality of minor projections 73, central depressions 74, and interleaved gripping depressions 84. Each gripping depression 84 has a greater width at its free rim and a smaller width at its rim that merges with the curved wall 50, while each minor projection 73 has a smaller width at its free rim and a greater width at its rim that merges with the curved wall.

The curved wall 50 is merged with the circular wall 40 and the closure skirt 60, thereby defining a radius of curvature R1 from approximately 1.5 mm (0.590551 in) to approximately 1.9 mm (0.748031 in).

From the perspective of the outer face of the crown cap 30, its circular wall 40 is slightly convex, having a radius of curvature R2 from approximately 178 mm (7.0078 in) to approximately 228 mm (8.9763 in).

Figure 7C:
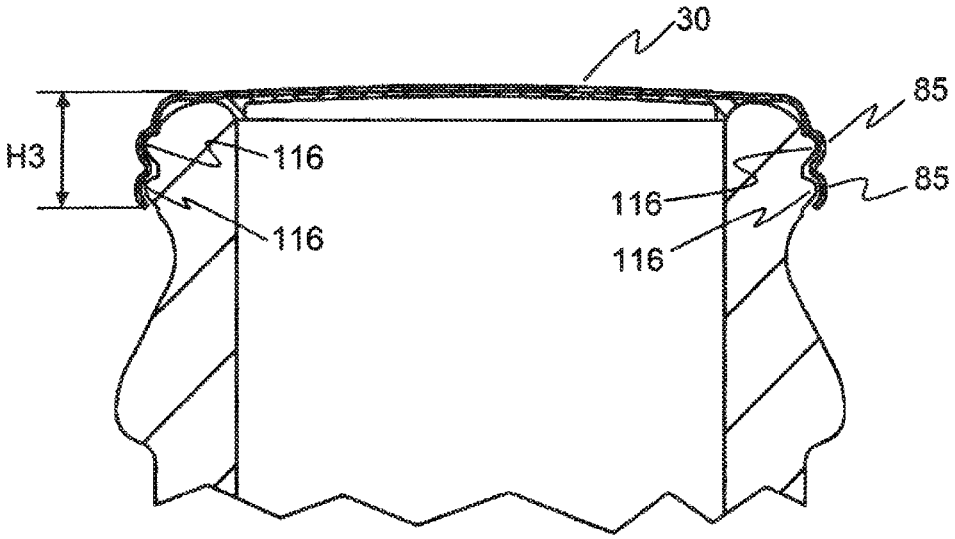
FIG. 7C shows a cross-sectional view of a crown cap according to the invention, sealing a threaded crown finish glass bottle mouth.

The closed crown cap 30 has an axial height H3 from approximately 5.3 mm (0.208661 in) to approximately 5.8 mm (0.228346 in), With reference to FIG. 7C, a sealed threaded crown finish glass bottle mouth 10 is illustrated with a folded crown cap 30. In addition to the technical elements described above in FIGS. 7A, 7B, and 7C, the folded closure skirt 60 further has a threading 85 interlocked onto the threads 116 of the mouth 10 of the threaded crown finish glass bottle.

The plurality of minor projections 73, central depressions 74, and gripping depressions 84 increase the area of contact of the surface of the folded closure skirt 60 for a correct and comfortable grip of the crown cap 30 for manual opening or by applying a torque to turn it.

Each minor projection 73 in its central depression 74 is sufficiently separated from the outer rim of the mouth 10 of the glass bottle to allow the engagement of a bottle opener for correct opening of the crown cap 30 under this embodiment, without causing damage to the mouth 10 of the glass bottle or to the crown cap 30 itself.

Based on the alternative embodiments described, it is contemplated that modifications to each of the described embodiments, as well as alternative application embodiments, will be considered obvious to a person skilled in the art of the technique under the present specification. It is therefore contemplated that the claims encompass said modifications and alternatives that are within the scope of the present invention.

Having described the invention as above, the content of the following claims is claimed as proprietary:

1. A crown cap configured to seal a mouth of a crown finish or threaded crown finish glass bottle, the crown cap comprising a laminar plate with an inner face and an outer face, formed by a circular wall, a curved wall perimetrical to the circular wall, and a closure skirt that descends radially downward and outward from the curved wall and formed by a plurality of interleaved projections and depressions; wherein in a pre-closure condition of the crown cap the curved wall has a radius of curvature from 1.5 mm (0.590551 in) to 1.9 mm (0.748031 in) and an arc less than 86°.

2. The crown cap according to claim 1, wherein the curved wall has an arc from 68° to 76°.

3. The crown cap according to claim 1, wherein it has an axial height from 5.3 mm (0.208661 in) to 5.8 mm (0.228346 in).

4. The crown cap according to claim 1, wherein it is formed from a circular sheet cutout with a diameter from 33.4949 mm (1.3187 in) to 35.5346 mm (1.399 in).

5. The crown cap according to claim 1, wherein each projection includes an inverted triangular wall formed between a pair of opposite convex flanks, wherein the inverted triangular wall descends from the curved wall in the outward direction of the crown cap and merged with the convex flanks; and each depression includes a flat central wall formed between a pair of opposed convex flanks, and a concave lower wall, wherein the flat central wall descends from the curved wall substantially parallel to the axis of the crown cap and is merged with opposite convex flanks, and wherein the concave bottom wall descends from the flat central wall and the opposite convex flanks in the outward direction of the crown cap.

6. The crown cap according to claim 5, wherein each projection has a width less than the width of each depression.

7. The crown cap according to claim 5, wherein the inverted triangular wall defines a radius of curvature from 8.74 mm (0.3440 in) to 9.04 mm (0.3559 in).

8. The crown cap according to claim 1, wherein the closure skirt has from 17 to 27 projections.

9. A crown cap configured to close and seal a mouth of a crown finish or threaded crown finish bottle, the closed crown cap comprising a laminar piece formed by a circular wall, a curved wall perimetrical to the circular wall, and a closure skirt marginally folded on the mouth of the glass bottle and descending radially downward from the curved wall, wherein in a pre-closure condition of the crown cap the curved wall has an arc less than 86°, wherein the closure skirt includes minor projections and interleaved gripping depressions, wherein each minor projection includes a central depression between a pair of opposite second convex flanks and each gripping depression includes a securing groove and a contact wall.

10. The closed crown cap according to claim 9, wherein each gripping depression has a greater width at its free rim and a smaller width at its rim that merges with the curved wall, and each minor projection has a smaller width at its free rim and a wider width at its rim that merges with the curved wall.

11. The closed crown cap according to claim 9, wherein the closure skirt also includes threading interlocked onto threads of the mouth of the threaded crown finish glass bottle.

12. The closed crown cap according to claim 9, wherein it has an axial height from 5.3 mm (0.208661 in) to 5.8 mm (0.228346 in).

13. The closed crown cap according to claim 9, wherein it is formed from a circular sheet cutout with a diameter from 33.4949 mm (1.3187 in) to 35.5346 mm (1.399 in).

14. The closed crown cap according to claim 9, wherein each gripping depression has a greater width at its free rim and a smaller width at its rim that merges with the curved wall, and each minor projection has a smaller width at its free rim and a wider width at its rim that merges with the curved wall.

15. A crown cap configured to seal a mouth of a crown finish or threaded crown finish glass bottle, the crown cap comprising a laminar plate with an inner face and an outer face, formed by a circular wall, a curved wall perimetrical to the circular wall, and a closure skirt that descends radially downward and outward from the curved wall and formed by a plurality of interleaved projections and depressions; wherein the curved wall has a radius of curvature from 1.5 mm (0.590551 in) to 1.9 mm (0.748031 in) and an arc less than 86°, wherein the crown cap is configured to transition between a pre-closure state and a closure state, wherein in the closure state, an axial height of the crown cap is between 5.3 mm (0.208661 in) to 5.8 mm (0.228346 in).

16. The closed crown cap according to claim 9, wherein each minor projection in its central depression is sufficiently separated from an outer rim of the mouth of the bottle to allow the engagement of a bottle opener for correct opening of the crown cap.

* * * * *